United States Patent [19]

Zeidler et al.

[11] Patent Number: 4,953,863

[45] Date of Patent: Sep. 4, 1990

[54] GAME ASSEMBLY

[76] Inventors: Douglas D. Zeidler; Dennis E. Zeidler, both of Rte. 1, Box 69M, Floyds Knobs, Ind. 47119

[21] Appl. No.: 333,988

[22] Filed: Apr. 5, 1989

[51] Int. Cl.[5] ..... A63B 7/00

[52] U.S. Cl. ..... 273/113; 273/118 R; 273/123 R; 273/118 R

[58] Field of Search ..... 273/118 R, 113, 108–110, 273/123 R, 153 S

[56] References Cited

U.S. PATENT DOCUMENTS

| | | | |
|---|---|---|---|
| 1,519,850 | 12/1924 | Lautzenheiser | 273/118 R |
| 3,069,805 | 12/1962 | Burrows | 44/16 |
| 3,406,971 | 10/1968 | Koff | 273/109 |
| 3,696,549 | 10/1972 | Zillus | 46/43 |
| 3,993,313 | 11/1976 | Tillotson | 273/130 |
| 4,067,576 | 1/1978 | Bales et al. | 273/282 |
| 4,553,749 | 11/1985 | Bender et al. | 273/1 R |
| 4,593,908 | 6/1986 | Ibrahim | 273/153 S |
| 4,822,047 | 4/1989 | Treer | 273/113 |
| 4,822,049 | 4/1989 | Biber | 273/113 |
| 4,861,036 | 8/1989 | Watanabe | 273/113 |

*Primary Examiner*—Randall L. Green
*Assistant Examiner*—Gary Jackson
*Attorney, Agent, or Firm*—Wm. R. Price

[57] ABSTRACT

A game assembly includes a plurality of toy blocks or cubes containing passsageways which are strategically stacked so as to determine the path of a ball dropped through interconnecting passageways within the arrays of stacked blocks or cubes. The blocks or cubes may be strategically reoriented during play so as to change the path of a ball dropped through the blocks or cubes. The game involves inspecting and/or memorizing moves made by the players taking part in the game, as well as geometric orientation of the blocks or cubes, so as to define a desired path for a ball which is dropped through the stack. A collection plate below is marked with certain designated areas, preferably in color and each player tries to get as many balls as possible through the stack and into his designated area or to predict the exact location for each ball.

17 Claims, 4 Drawing Sheets

GAME ASSEMBLY

BACKGROUND OF THE INVENTION

This invention relates to a game assembly which involves skill and intellect of the players when strategically orienting and placing a series of stacked cubes containing passageways so as to affect the path of a ball dropped through interconnected passageways contained therein and simultaneously adversely affecting the path of a ball dropped by an opponent through the stacked cubes to achieve a specified goal.

DESCRIPTION OF THE PRIOR ART

Applicant has had made a search in the following classes and subclasses:

| CLASS | SUBCLASS |
|---|---|
| 273 | 109, 120, 153, 236, 241, 258 and 276 |
| 446 | 124, 168 and 170 |

The following references were uncovered:

| PATENT NUMBER | INVENTOR | ASSIGNEE | DATE |
|---|---|---|---|
| 3,696,549 | Zillus | CBS, Inc. | 1972 |
| 4,553,749 | Bender, et al | | 1985 |
| 1,519,850 | Lautzenheiser | | 1924 |
| 3,069,805 | Burrows | | 1962 |
| 3,406,971 | Koff | | 1968 |
| 3,993,313 | Tillotson | | 1976 |
| 4,067,576 | Balas, et al | | 1978 |

SUMMARY OF THE INVENTION

Subdivided cubes containing internal passageways are strategically arranged in vertical and horizontal arrays to beneficially affect the travel of a ball dropped therethrough. Simultaneously, the cubes are arranged so as to adversely affect the path of a ball dropped by an opponent through the arrays of stacked cubes. It is the goal of the game assembly to collect as many balls as possible of a particular player within a designated area or single position of the collection plate. Another goal is to prevent the balls of an opposing player from reaching the designated area assigned to him. A single player competes against himself. The collection plate is marked with designated areas, preferably in color and contains a series of holes in which the balls are collected. A frame and wire assembly is slidably positioned beneath the collection plate so that the wires are in registry with the holes of the collection plate to collect the balls contained therein. A support plate contains a mirror so that all of the balls of all of the players can be seen by reflection. After tallying the points for each player, the frame and wire assembly is slidably moved so as to release the balls and allow for another round of play. The game involves a great amount of skill, memory and strategic orientation in stacking the cubes so as to beneficially affect the path taken by a ball of the player and adversely affecting the path of a ball of his opponent. The game therefore involves a strategic insight of the player so as to fully comprehend the ramifications of movement during the course of play.

DESCRIPTION OF THE PREFERRED EMBODIMENT

Figure 1:
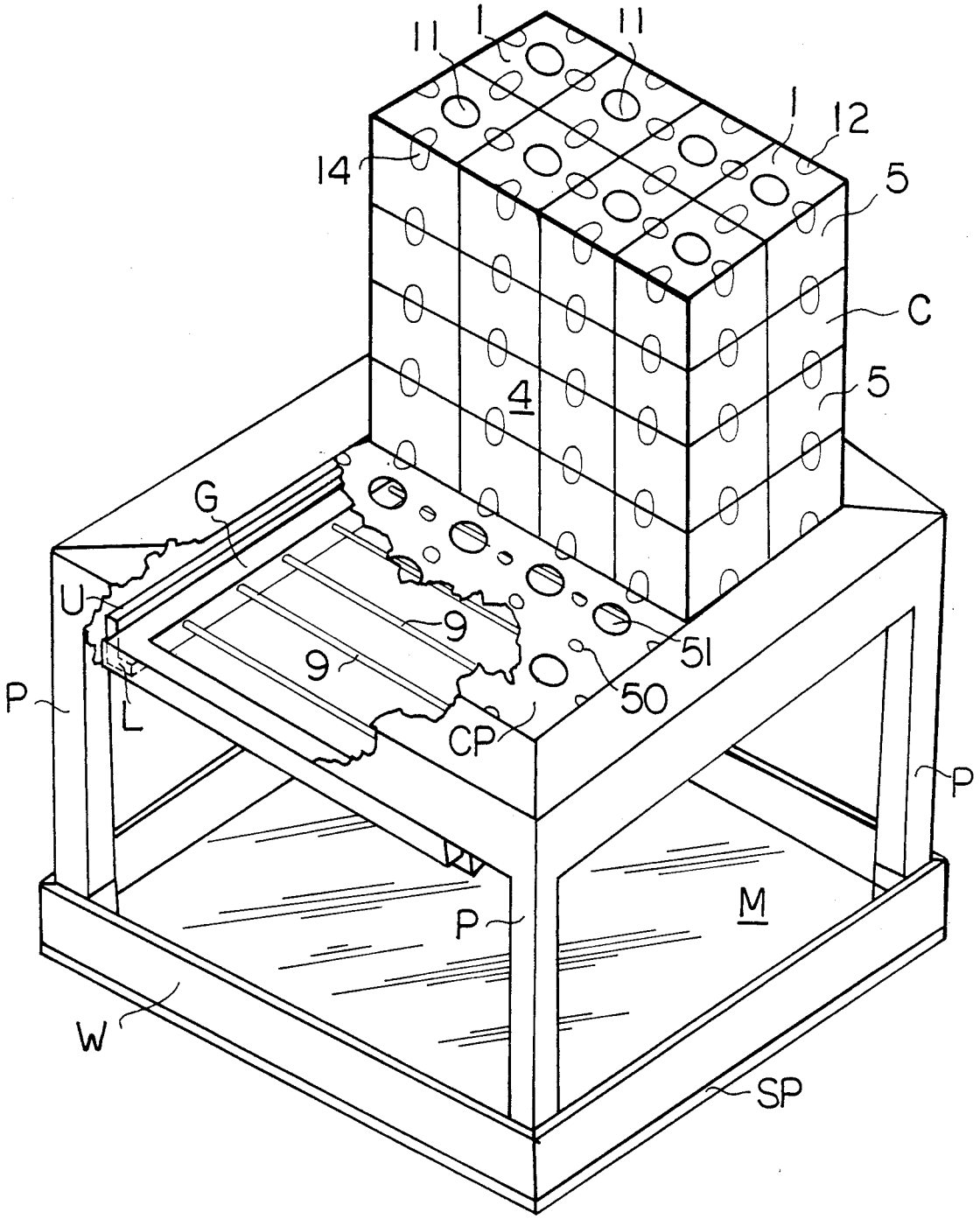
FIG. 1 is a view in perspective of the game assembly of this invention with portions broken away for purposes of illustration.

FIG. 1 illustrates the game assembly with parts broken away to illustrate its construction and the organization in play. The game assembly consists of a support plate SP, having a peripheral wall W and a mirror M mounted thereon. Four posts P are mounted to the support plate at the bottom and to the collection plate CP at the top. The collection plate contains rows of holes or openings 50 and socket members 51 (alternately) surrounding certain holes 50. A frame F, containing transverse wire members 9, is fitted into a guide member G which has been rabbetted to contain an upstanding portion U and a ledge portion L. The wire members 9 are spaced so as to register with the rows of holes 50 in the collection plate so as to engage a ball 30 dropped through passageways of the stacked cubes and to hold it in position until the frame is slidably moved in the guide members G to bring the wire members 9 out of engagement with the rows of holes 50, thus allowing the balls to fall onto the mirror M of the collection plate CP of the support plate SP. Wall members W prevent the balls from rolling onto the floor. It will be apparent that as the balls 30 are collected in the holes 50, they can be viewed by their reflection in the mirror M, to determine which of the balls are within a designated area 52, 53, 54 or 55 of the collection plate CP, as will be hereinafter more fully explained.

Figure 2:
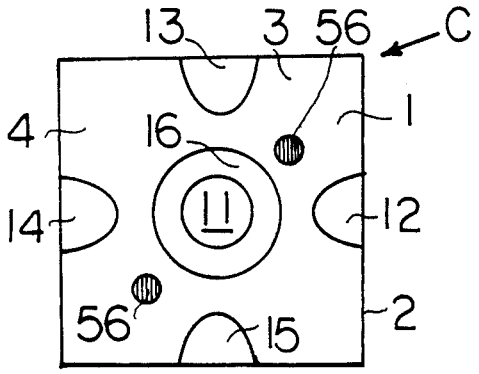
FIG. 2 is a top view of one of the cubes used in the game assembly of this invention.
Figure 3:
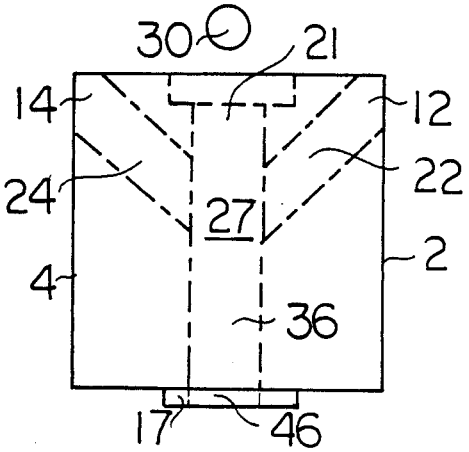
FIG. 3 is a side elevation of the cube shown in FIG. 2 with some of the internal passages of the cube shown in phantom lines.

The individual cubes C forming the vertical and horizontal arrays are illustrated in FIGS. 2 and 3. FIG. 2 shows a top plan view of the cube C, having an upper face 1 and side faces 2, 3, 4 and 5. An upper entry opening 11 is shown in the center of the upper face 1. A side entry opening 12 is shown at the midpoint of the two corners of the side face 2 and at the intersection of upper face 1 and side face 2. Side entry openings 13, 14 and 15 are also located at the midpoint of the edge of each tube, at the intersections of the upper face 1 and side face 3, upper face 1 and side face 4 and upper face 1 and side face 5, respectively. Additionally, a socket member 16 is shown surrounding the upper entry opening 11.

Figure 4:
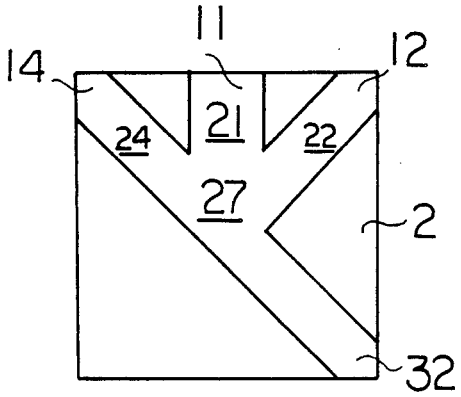
FIGS. 4 and 5 are sectional views of the cubes of this invention, showing some of the internal passages of this invention.
Figure 5:
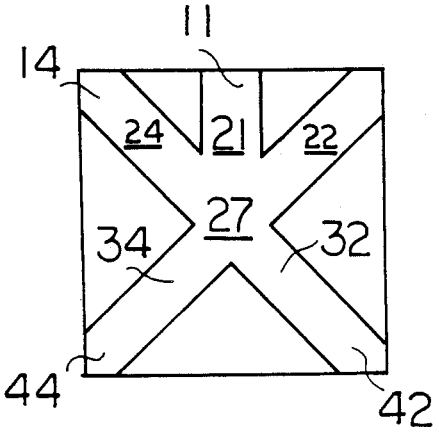
Figure 6:
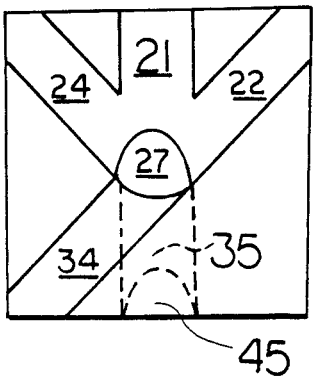
FIG. 6 is a sectional view of an individual cube of this invention with one internal passageway illustrated in phantom lines.

FIG. 2 shows that the side entry opening 12 communicates with a side entry passageway 22 and the center entry opening 11 communicates with the center passageway 21 and the side entry opening 14 communicates with side entry passageway 24. In like manner, side entry openings 25 and 23 communicate with side entry openings 25 and 13, but are not illustrated in this figure. As is clear, all of the entry passageways 21, 22, 24 (as well as unillustrated as 23 and 25) converge at 27 to a common chamber. A center exit passageway 36 communicates with the common chamber 27 and the center bottom exit opening 46 on the bottom face 6. Surrounding the center bottom exit opening is a projecting lug 17 which interconnects into the socket 16 on the upper face of each of the cubes for stacking stability. Additionally, the projecting lug 17 will interconnect in a male and female fashion with the socket 51 of the collection plate CP. It should be clear that a ball dropped in any of the entry openings 11, 12, 13, 14 or 15 will travel through the respective entry passageways 21, 22, 24, etc., into the common chamber 27 and exit through exit passageway 36 and out the exit opening 46 at the bottom of the cube. However, as is illustrated in FIGS. 4, 5 and 6, all of the exit openings are not identical for the cubes. Thus, for example, in FIG. 4, exit opening 32 communicates with the common chamber 27 so as to exit at the exit opening 42. In FIG. 5, however, the common chamber 27 communicates with two exit passageways 32 and 34, which exit at exits 44 and 42, respectively. Thus, a ball 30, dropped into the center inlet opening 11, will travel via passageway 21 to the common chamber 27 and then may randomly travel either through passageway 32 or 34 out of exit 42 or 44. Additionally, as is shown in FIG. 6, exit passageways 34 and 35 are in communication with the common chamber 27 to exit at the exit openings 44 and 45, respectively. Thus, a ball dropped through entrance opening 11 will travel via channel 21 to the common chamber 27 and then may travel through exit passage 34 and out exit opening 44 or may travel through exit passage 35 to exit opening 45. Side exit passageway 33 and opening 43 are not shown. 6

*FIGS. 4–7 do not include socket 16 or lug 17 for purposes of clarity.

Figure 7:
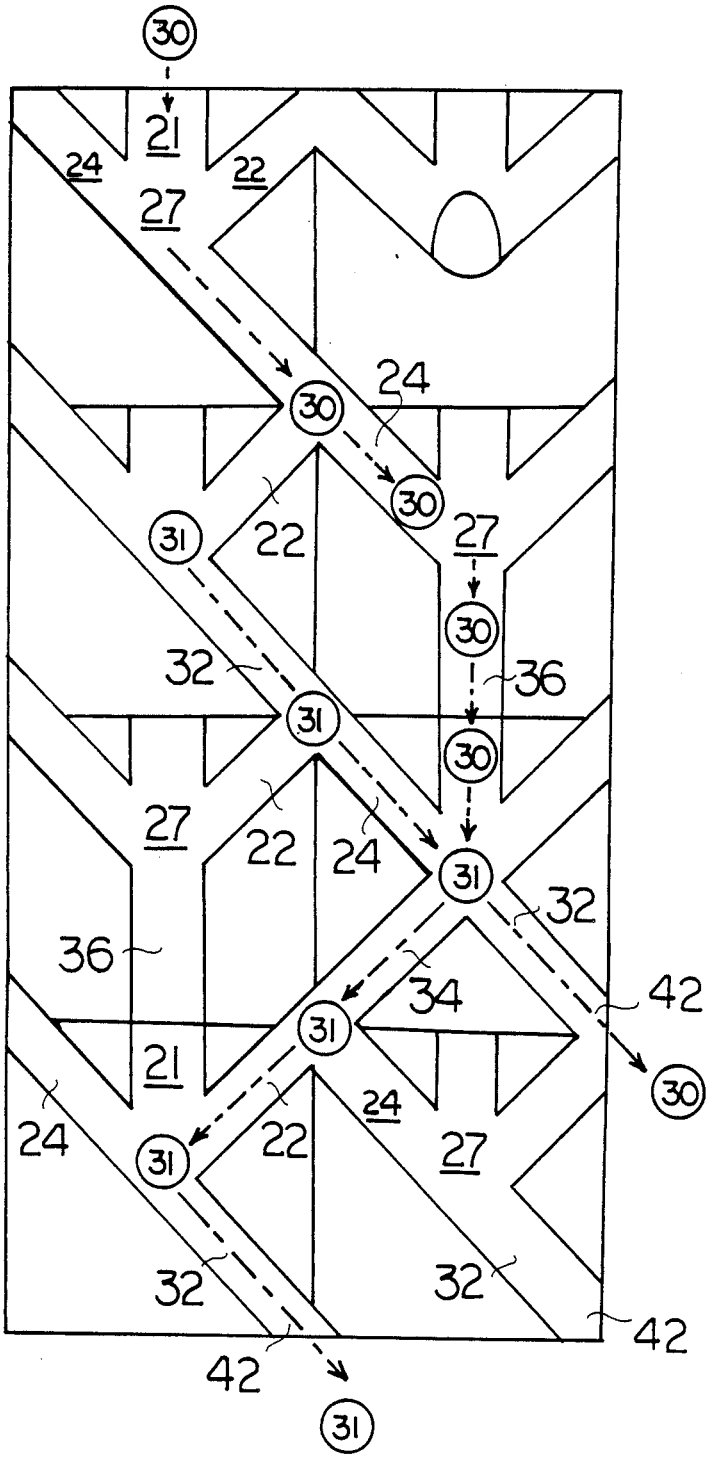
FIG. 7 is a sectional view of stacked cubes in vertical and horizontal array, illustrating the interior connecting passages of the stacked cubes and illustrating the possible paths of a ball or a series of balls dropped through one of the entry openings of said cube.
Figure 8:
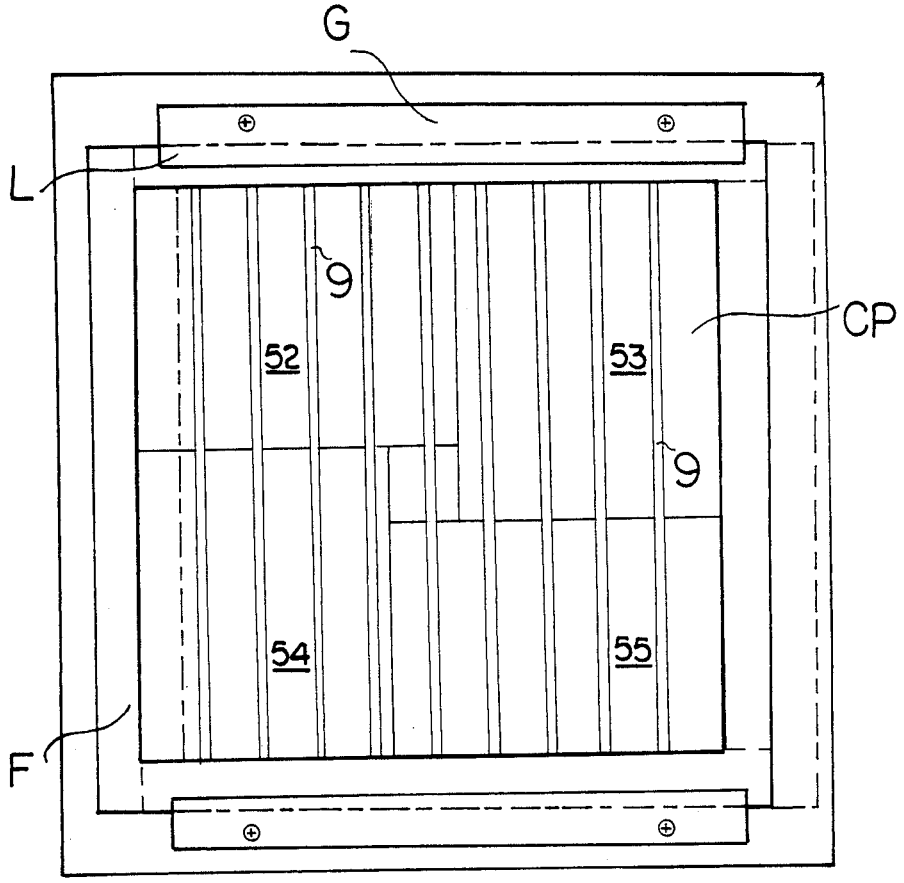
FIG. 8 is a view from the bottom illustrating the frame and wire assembly slidably mounted in the frame member below the collection plate and further illustrating the designated outlet areas of the collection plate.

FIG. 7 illustrates a vertical and horizontal array of two cubes stacked to demonstrate the interconnecting paths possible. In this illustration, it is assumed that balls 30 and 31 are dropped into the same entry opening 11 at the left hand of the stack. However, because of the random nature of some of the arrangements, it is possible for each succeeding ball to take a different path. Thus, ball 30, dropped in entry opening 11 will travel through entry passageway 21 to the common chamber 27 and thence through exit passageway 32 to the entrance side passageway 24 to the common chamber 27 and thence through exit 36, through entrance passageway 21 to the exit passageway 32 and out the side exit passage at 42. Ball 31, on the other hand, as is illustrated, turns into the side entrance 22 in the next-to-the-top cube of the stack on the left-hand side, turns again from chamber 27 of that cube into side exit chamber 32, through the side entrance chamber 24 and into chamber 27 and turns then to the left at side exit chamber 34 to turn at the side entry passageway 24 into chamber 27, to exit then through exit passage 32 and exit outlet 42.

Alternate routes are shown to illustrate the strategic planning required to place the cubes in the proper sequence and arrangement to get the desired number of balls in the designated area of the player. The designated areas of the player are shown on the bottom of collection plate CP as 52, 53, 54 and 55 and normally are colored so as to easily designate the positioning of the balls for each player. The balls themselves can also be colored or designated in some way or it is possible to use a series of so many balls for each player, mark the score and start over again. In any event, due to the reflection of the mirror M, the balls which are collected within a certain designated area can be easily viewed through the reflected area, resting on the wires W, in registry with the rows of holes 50 of the collection plate. After the balls are counted, by moving the frame member 50 and the wires trained thereon out of registry with the holes, the balls will fall to the mirror portion and can be collected for replay. It is preferred to mark the collection plate by color: however, the color hatching was not done in this instance for purposes of clarity of illustration.

VARIATIONS

While the side entry holes have been shown to be at the midpoint of each edge of the intersection of the side face and the upper face, it is, of course, clear that the side entry holes could be at the corners with connecting passageways. What is necessary is that the entry holes be positioned in such a way to communicate with one or more of the exit holes so that a ball will pass to the next cube in stacked array. Therefore, the intersection of the side face and the upper face is meant to mean the intersection at a definite point along the edge or a definite point at the corner. In this instance, of course, the exit passage would also have to be in the center or at the corner, as the case may be.

Additionally, 3×3×5 or 5×5×5 configurations of identical cubes may be utilized, it being understood a larger number of cubes in a configuration increases the number of possible exit passageways. The blocks could have shapes other than cubes: pyramids, rectangles, two or more cubes bonded together are examples. The collection plate could be altered to have a series of electronic switches and lights to indicate where each ball exits. A variety of stacking arrangements are possible. A stack consisting of a 7×7 lower layer, a 5×5 second layer, and a 3×3 third layer would be possible.

Configurations without actually using blocks are also possible. A video version of the game is possible. Alternately, a fixed array of passages with movable switch gates could be used to direct the courses of the balls.

Player pieces other than balls can be utilized. This would include oval members, cube members or other shapes. It is to be understood that in such cases, the shape of the passageways might have to be modified.

Figure 9:
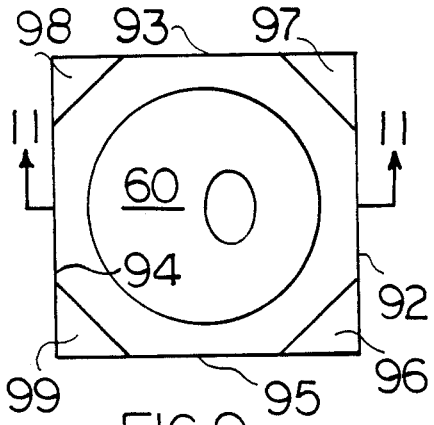
FIG. 9 illustrates a variation of a cube in which the five upper entry openings of the top face of the cube have been replaced with an opening of an inverted conical chamber.
Figure 10:
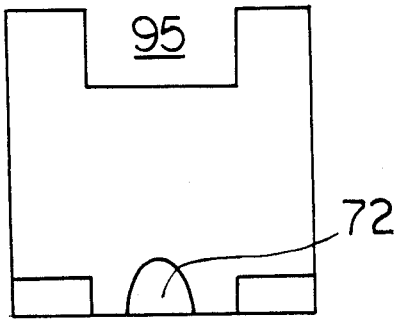
FIG. 10 is a side elevation, illustrating another view of the modified cube of FIG. 9.
Figure 11:
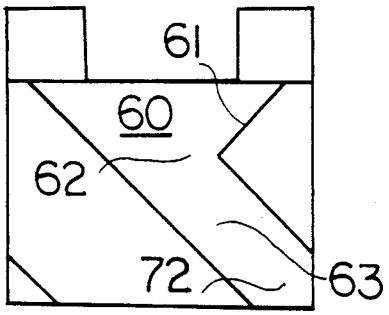
FIG. 11 is a sectional view, taken along 11—11 of FIG. 9, illustrating the cube of this invention.
Figure 12:
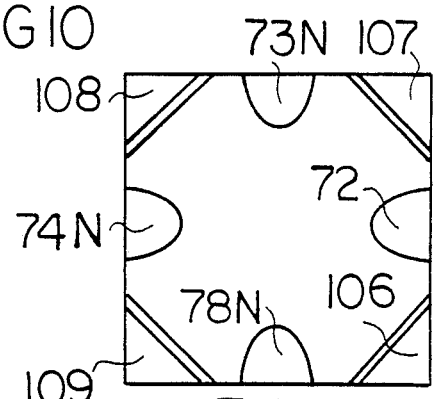
FIG. 12 is a bottom view of the modified cube of FIG. 9.

A modified cube has been illustrated in FIGS. 9–12, in which the upper face of the cube has been changed to include the opening of a conical chamber 60, defined by inclined walls 61, reaching to the vertex 62. The vertex contains an opening which, as is shown in FIG. 11, is to a passageway 63, which exits at side opening 82. As with the previous cubes, there are other side exit openings corresponding to 64, 65 and 66 (not shown), which could extend up to the vertex 62 of the conical chamber 60 and allow for two or more exit passageways from the cube. Entrance passageways, which are illustrated in FIGS. 9, 10 and 11, are carved from the top of the walls of the face so as to communicate with the conical chamber 60. These passageways are designated as 92, 93, 94 and 95. Since the central lugs and recesses cannot be used, triangular lugs 96, 97, 98 and 99 are left in the face to match with the triangular recesses 106, 107, 108 and 109, in the bottom of the cube, as is shown in FIG. 10. This allows for stacking stability, instead of using the lug and socket connection, as previously indicated. Additionally, notches 73N, 74N and 75N are shown in the bottom face of the cube, rather than the exit hole 72, so as to allow for passage of a ball or other playing member from one cube to an adjacent lower cube. Triangular lugs and triangular recesses can, of course, be replaced with pins and matching holes in the available surfaces of the top and bottom faces of cubes. This does provide stability and easy stacking of the cubes vertically.

RULES

The skill of this game is determined by the strategic planning of stacking of the cubes. The blocks are stacked in such a way that a ball will exit within the designated area of the player. Further, the cubes are stacked in such a way so as to prevent the balls of an opponent from landing in his designated area. Therefore, the rules can call for the winner of the game or the winner of a toss of the coin to be the party to stack all of the cubes. Additionally, a single player may compete with himself in a game or use the assembly to sharpen his skills.

Alternately, each player can stack his cubes, allowing his opponent to stack his cubes. This, then allows for the strategic stacking of cubes to the benefit of the player and to the detriment of the opponent. In a preferred embodiment, indicia 56 are shown on the upper face 1 of each cube, indicating the positioning of the exit of the ball. This would then facilitate the strategic stacking of the cubes.

It is within the scope of this invention, however, to eliminate such indicia and to leave all of the strategic planning to the memory of the party doing the stacking to further complicate the problems of stacking for the player's benefit and for the opponent's detriment.

Many modifications will occur to those skilled in the art from the detailed description herein given and such is meant to be exemplary in nature and nonlimiting, except so as to be commensurate in scope with the appended claims.

We claim:

1. A game assembly, comprising in combination:

A. a plurality of balls;

B. a plurality of cubes adapted to be stacked in arrays, each cube comprising:

1. six faces, including:
   a. a top face;
   b. a bottom face; and
   c. four side faces;
2. engagement means, including:
   a. a first engagement means on the top face;
   b. a second engagement means on bottom face;
3. an opening in the center of the top face;
4. an opening along the edge of the intersecting side faces and the top face of each cube;
5. entry passageways running from each opening to a common chamber within said cube;
6. at least one exit passageway in communication with said common chamber;
7. an exit opening in operative relationship with said exit passageway in the area of the bottom face of said cube;
8. said exit passageway being in operative relation with the entry openings or the center opening of an adjacent cube;

C. a plurality of interconnected passages formed by an array of stacked cubes allowing uninterrupted passage of said plurality of balls through different passageways;

D. a board in spaced and parallel relationship to the bottom plane of said arrays of stacked cubes, comprising:

1. two or more designated areas for collection of balls dropped through said stacked cubes.

2. A game assembly, as defined in claim 1, in which said exit opening is at the intersection of a side face and the bottom face of said cube.

3. A game assembly, as defined in claim 1, in which there is more than one exit passageway and in which each of said exit passageways has an exit opening in operative relation therewith at different points in the area of the bottom face of said cube,

4. A game assembly, as defined in claim 1, in which said exit opening is in the center of the bottom face of said cube.

5. A game assembly, as defined in claim 1, in which there is more than one exit passageway and in which one of said exit passageways has an exit opening at the intersection of a side face and the bottom face of said cube and in which the second of said exit passageways has an opening at the center of the bottom face of said cube.

6. A game assembly, as defined in claim 1, in which there is more than one exit passageway and in which one of said exit passageways has an opening at the intersection of a side face and the bottom face of said cube and in which the other of said exit passageways has an exit opening at the intersection of a different side face and the bottom face of said cube

7. A game assembly, comprising in combination:

A. a plurality of balls;

B. a plurality of cubes adapted to be stacked in horizontal and vertical arrays, in which each cube has:

1. six faces, including:
   a. a top face:
   b. a bottom face; and
   c. four side faces;
2. an opening in the center of the top face:
3. openings along each edge formed by the intersection of the top face and the side faces:
4. entry passageways running from each opening to a common chamber within said cube;
5. at least one exit passageway in communication with said common chamber;
6. an exit opening for said exit passageway in the area of the bottom face of said cube;

C. a collection board in spaced and parallel relationship to the bottom planar surface of the bottom horizontal array of said cubes, comprising:

1. two or more designated areas for collection of balls dropped through said stacked arrays of cubes;
2. a plurality of openings arranged in spaced relationship on said board for collection of individual balls;

D. a frame and wire assembly which comprises:
1. peripheral frame members;
2. wire members stretched across said frame member in spaced relationship, corresponding to the spaced rows of openings in said board;

E. support means for said frame and wire assembly for slidably moving said frame and said wire members in and out of registry with the holes in said board;

F. a lower support plate and a reflective mirror for viewing the collection board reflected therein.

8. For use in a game assembly, in which a plurality of balls are dropped through a plurality of interconnecting passageways in vertical and horizontal arrays of cubes formed by vertical and horizontal arrays of cubes, for uninterrupted passage of said balls therethrough, A. the improvement which comprises rows of cubes with unobstructed interconnecting passages in which each cube comprises:

B. six faces, including:
1. a top face;
2. a bottom face; and
3. four side faces;

C. an opening in the center of the top face;

D. an opening along the edge of intersecting side faces and top face of each cube;

E. entry passageways running from said opening to a common chamber within said cube;

F. at least one exit passageway in communication with said common chamber;

G. an exit opening in operative relation with said exit passageway in the area of the bottom face of said cube;

H. said exit opening in operative relation with the entry passageway of an adjacent cube.

9. A cube, as defined in claim 8, in which said exit opening is at the intersection of a side face and the bottom face of said cube.

10. A cube, as defined in claim 8, in which there is more than one exit passageway and in which each of said exit passageways has an exit opening in operative relation therewith at different points in the area of the bottom face of said cube.

11. A cube, as defined in claim 8, in which there is more than one exit passageway and in which one of said exit passageways has an exit opening in operative relation therewith at the center of the bottom face of said cube and in which the other exit passageway has an exit opening in operative relationship therewith at the intersection of a side face and the bottom face of said cube.

12. A cube, as defined in claim 8, in which said exit opening is located in the center of the bottom face of said cube.

13. A cube, as defined in claim 8, in which there is more than one exit passageway and in which each of said exit passageways has an opening in operative relationship therewith, and in which one of said exit passageways is at the intersection of a side face and the bottom face of said cube and in which the other exit opening is at the intersection of the bottom face and another side face of said cube.

14. A cube, as defined in claim 8, in which indicia means are on the top face of said cube, to indicate the exit opening near the bottom face of said cube.

15. A cube, as defined in claim 8, in which each of the intersecting side and bottom faces, which does not contain an exit opening, contains a semicircular notch, angularly disposed.

16. A game assembly, comprising in combination:

A. a plurality of balls;

B. a plurality of cubes adapted to be stacked in arrays, each cube comprising:
1. six faces, including:
a. a top face;
b. a bottom face; and
c. four side faces;
2. engagement means, including:
a. at least one engagement means on the top face;
b. at least one engagement means on the bottom face;
3. an opening in the center of the top face in the form of a conical chamber, defined by inclined walls which form a vertex in the interior of said cube;
4. entry openings along the edge of said cube which communicate with said conical chamber;
5. at least one exit passageway in communication with said vertex of said conical chamber;
6. an exit opening in operative relationship with said exit passageway in the area of the bottom face of said cube;
7. said exit passageway being in operative relation with the entry openings or the center opening of an adjacent cube;

C. A plurality of interconnected passages formed by an array of stacked cubes allowing uninterrupted passage of said plurality of balls through different passageways;

D. a board in spaced and parallel relationship to the bottom plane of said arrays of stacked cubes, comprising:
1. two or more designated areas for collection of balls dropped through said stacked cubes.

17. A game assembly, as defined in claim 16, in which said first engagement means is in the form of an angular lug at the corner of the top face of one cube and the second engagement means is in the form of a triangular recess at the bottom face of an adjacent cube, for mutually-conjunctive engagement of the top face of one cube to the bottom face of a second cube.

* * * * *